United States Patent [19]

Laauwe

[11] 4,226,342

[45] Oct. 7, 1980

[54] DISPENSING VALVE PARTICULARLY FOR VISCOUS PRODUCTS

[76] Inventor: Robert H. Laauwe, 237 Green Ridge Rd., Franklin Lakes, N.J. 07417

[21] Appl. No.: 969,796

[22] Filed: Dec. 15, 1978

[51] Int. Cl.[3] ..... B05B 11/04

[52] U.S. Cl. ..... 222/494

[58] Field of Search ..... 222/494, 498, 521, 212

[56] References Cited

U.S. PATENT DOCUMENTS

| | | | |
|---|---|---|---|
| 1,880,103 | 9/1932 | Murdoch | 222/494 |
| 1,972,344 | 9/1934 | Jackson | 222/494 |
| 2,025,810 | 12/1935 | Dinnes | 222/494 |

FOREIGN PATENT DOCUMENTS 426625 6/1967 Switzerland .

*Primary Examiner*—Stanley H. Tollberg

*Attorney, Agent, or Firm*—Kenyon & Kenyon

[57] ABSTRACT

A dispensing valve, particularly adapted for a squeeze bottle containing a viscous product, has a valve head in the form of a thin flat wafer of small diameter stationarily supported as freely as possible from obstructions, and above it an elastically deflectable diaphragm having a central opening with a periphery that seats on the periphery of the wafer. Internal pressure causes the diaphragm to move slightly from the wafer during a dispensing operation.

10 Claims, 3 Drawing Figures

DISPENSING VALVE PARTICULARLY FOR VISCOUS PRODUCTS

BACKGROUND OF THE INVENTION

Dispensing valves for collapsible tubes and squeeze bottles containing viscous products have been the subject of much experimentation as shown by various patents.

Such experimentation has followed the fundamental concept of an upstanding projection having a tip forming a valve seat, stationarily mounted by spokes or the like radiating from the projection's bottom to a rim fixed in one way or another to a collapsible tube or squeeze bottle mouth. Above the projection an elastically deflectable diaphragm is peripherally mounted by the rim, has a hole fitting the valve head more or less, and otherwise closes the space between the projection and rim. Product pressure moves the diaphragm from the projection for dispensing the product.

The above concept does not permit a viscous product such as hair shampoo, ketchup, etc., to be squeezed from the interacting valve parts for effective and prompt valve closing. The product clings to the projection and cannot flow from the valve seat promptly. If the diaphragm is strongly elastically biased to closing position, the normal user cannot squeeze the collapsible container adequately to obtain a valve-opening product pressure. To squeeze a viscous material from between mating surfaces of a valve using that fundamental concept, requires great pressure.

The 1929 Proctor U.S. Pat. No. 1,709,948 apparently started that concept, it disclosing a stationary upward projection having a top forming a semispherical seating member or valve head on which a diaphragm having a circumferential outer peripheral rib or corrugation seats via a centrally disposed opening.

This concept of an upwardly extending projection is repeated in an exaggerated form by the 1953 Schlocksupp U.S. Pat. No. 2,628,004. Here the diaphragm is designed to transmit linear motion to the part of the diaphragm having the hole working on the projection's top end.

The 1929 Proctor patent concept is repeated in the 1976 Clark U.S. Pat. No. 3,984,035, excepting that the stationary semispherical seating member is projected upwardly even further from its mounting means.

The Nilson U.S. Pat. Nos. 3,981,419 and 4,061,254, respectively issued in 1976 and 1977, provide further examples of the stationary valve head being formed as an upwardly projecting member.

To overcome the problem of a viscous product remaining between the fixed and movable surfaces of a dispensing valve, the present inventor, in his 1977 U.S. Pat. No. 4,057,177, discloses a dispensing valve for a squeeze bottle containing a viscous product, which features a sleeve valve actuation. Using a fixed valve head projection, and here again a projection was used, a diaphragm which is deflected by product pressure resulting from squeeze bottle finger squeezing, operates a sleeve valve which upon retraction from its open position has the characteristics of, in effect, shaving off viscous material from the relatively moving parts so that positive valve closing operation is effected.

SUMMARY OF THE PRESENT INVENTION

In the present instance, the inventor's object has been to provide a valve which handles viscous products as effectively as does his valve referred to above, but which will be of simpler construction, opens under less product pressure, requires the use of less material, normally plastic, for its parts, and which permits the use of a simplified injection mold cavity design.

This object is attained by a new dispensing valve having a base formed by a circular rim, a circular wafer and spokes connecting with and radiating from the wafer's bottom and extending radially to the rim in a plane below that bottom and positioning the wafer on and normal to the rim's axis. This wafer has a small diameter as compared to the rim's diameter so an annular open space is formed between the wafer and rim. Combined with this, there is a cap comprising an elastically flexible annular diaphragm positioned above the plane extending from the wafer's bottom and having a central opening with a periphery normally resting on the periphery of the wafer, and a depending flange connected to the rim of the base. The peripheries of the diaphragm's central opening and of the wafer have substantially mating conical surfaces.

This contrasts with the prior art in that no projection extends upwardly from the hub of the spokes, the latter being thin and mounting the wafer only by its bottom so that the wafer, in effect, floats stationarily in open space. When a viscous product is squeezed against the bottom of the diaphragm, it deflects upwardly so that the two peripheries separate. When the two peripheries return together, the product is free to flow from the mating conical surfaces to close easily and provide a positive shut-off.

To promote the above positive shut-off, the wafer is made very thin with a flat top and bottom, the spokes having upstanding inner tips which connect with that bottom only adjacent to the wafer's periphery, in effect leaving the wafer's entire surface free from obstructions in any direction.

The diaphragm is made with a shallow conical shape and extends integrally from the top of its flange, so as to form a cap for the base, downwardly to the wafer, the top portion of the flange being free from restraint to radial elastic flexure. With the cap comprising the diaphragm and its flange made from elastically flexible material such as the typical plastic, viscous product pressure on the inside or bottom of the diaphragm causes the diaphragm to move upwardly with consequent radial elastic flexure of its flange which then acts as an annular hinge with the central part of the diaphragm having the opening, swinging with respect to the wafer's periphery so that the mating conical surfaces of the wafer and diaphragm opening separate and come together in a swinging or arcuate manner. The motion involved is very small, being in the order of possibly a few thousandths of an inch, keeping in mind that the orifice through which the dispensed product passes is annular. Because the diaphragm is downwardly conical, it resists deformation in a bulging manner, its displacement occurring largely by outward swinging or hinging action of the unrestrained flange mounting the diaphragm's outer periphery.

Anticipating the possibility that the domestic user of a squeeze bottle provided with this valve might by finger pressure force the diaphragm inwardly far beyond its intended motion, the spokes of the base adjacent to the periphery of the wafer and slightly therebelow are formed with flat surfaces providing stops preventing excessive downward motion of the diaphragm.

When made of plastic typically used for valves of the present kind, the diaphragm must be made characteristically small in wall thickness. The wafer itself can be made with the same wall thickness. In other words, the wafer contrasts with the usual valve head projection in that the wafer is very thin.

The diaphragm's downward conical angularity with respect to the flat top of the wafer which is normal to the valve axis, does not have great downward conical angularity. This angularity may range from 3° to 15° with respect to the flat top of the wafer. The wafer diameter is small as compared to that of the diaphragm and is preferably not more than about one-third the diameter of the bottom of the diaphragm. This leaves a large diaphragm bottom area, or piston area, against which the product pressure works, so that in the case of a squeeze bottle relatively little finger pressure is required to obtain dispensing action by the valve. For easy operating, the diaphragm's bottom should have a diameter not smaller than 0.65", and the thickness of the wafer and diaphragm should range from 0.05 inch to 0.30 inch. For easy swinging action, the diaphragm's flange should preferably taper upwardly in thickness from its attachment to the base's rim upwardly to the diaphragm's connection with its flange.

BRIEF DESCRIPTION OF THE DRAWINGS

An example of the new valve as engineered for commercial production is illustrated by the accompanying drawings in which.

DETAILED DESCRIPTION OF THE DRAWINGS

Figure 1:
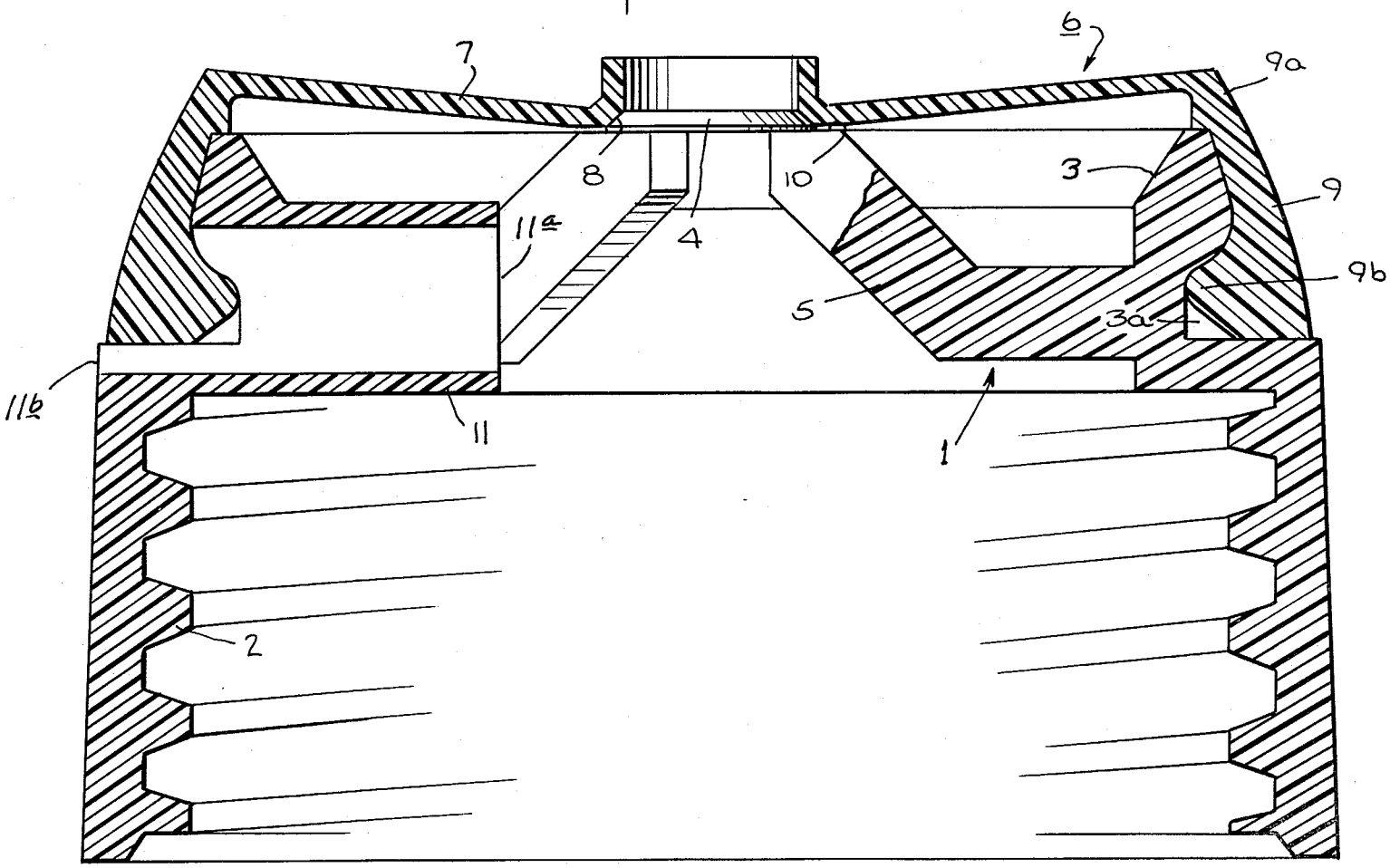
FIG. 1, on a greatly enlarged scale with respect to the actual valve, is a vertical section taken on the line A—A in FIG. 2.
Figure 2:
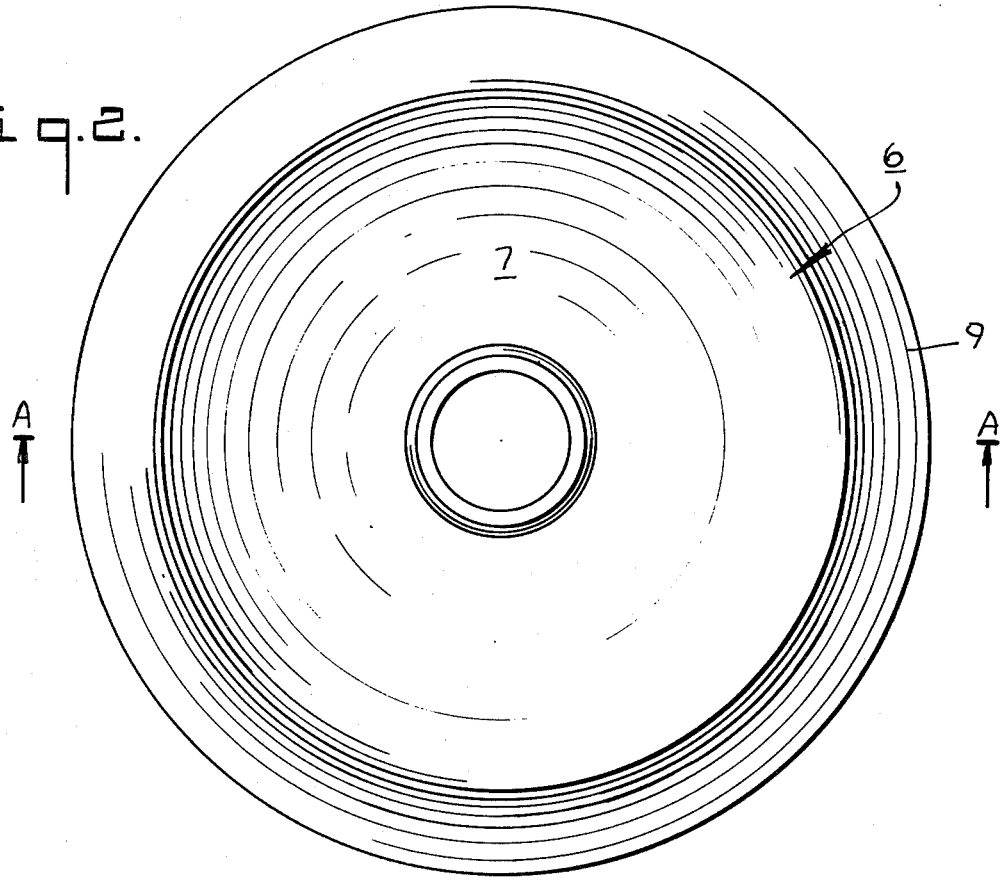
FIG. 2 is a top view of the valve's cap.
Figure 3:
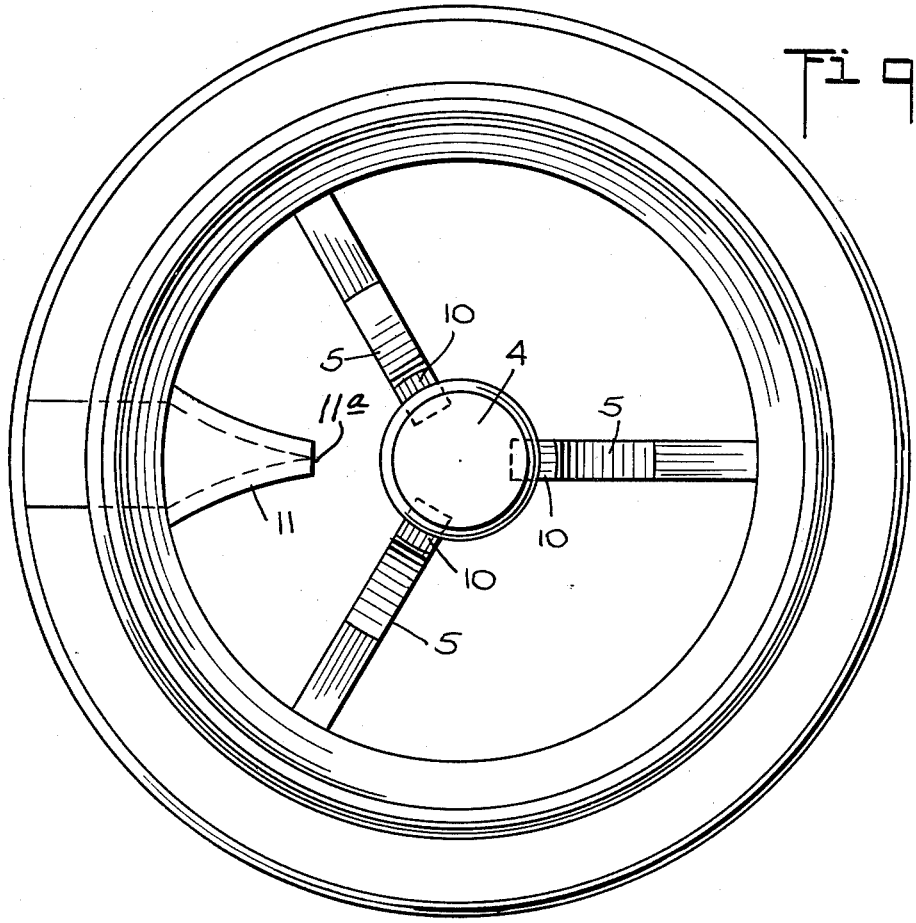
FIG. 3 is a top view of the valve's base.

The drawings show the base 1 in the form of an integral injection plastic molding and as having a skirt 2 which is internally threaded to fit the threads of a plastic squeeze bottle having a standard 28 mm threaded mouth, thus providing a means for connecting the base to the bottle mouth and, therefore, fastening the previously described circular rim 3 to the mouth. The thin circular wafer 4 has its bottom integrally joined with the inner tips of the upwardly inclined spokes 5 which radiate from that bottom and extend radially to join with the rim 3 in a plane well below the wafer's bottom, positioning the wafer on and normal to the rim's axis. As illustrated, the wafer has a small diameter as compared to the rim's diameter and forms an annular space between the wafer and rim.

In this specific example, the rim 3 has an outside diameter of 0.950" and the wafer 4 has a maximum diameter of 0.230" and a thickness of 0.015", these values being given to exemplify the small dimensions involved by the actual valve and not being intended to be restrictive.

The cap 6, also an integral plastic injection molding, has the elastically flexible annular diaphragm 7 positioned above the plane of the bottom of the wafer and having the central opening 8, coaxial with respect to the wafer 4 and the rim 3, and having the periphery which normally rests on the periphery of the wafer. The integral diaphragm flange is shown at 9 as depending from the diaphragm's periphery and connected to the rim 3 of the base. The connection is made by interconnecting peripheral parts formed by the base and cap respectively and which permit the assembly of the cap by it being pushed down and snapped onto the rim of the base, but other interconnecting means might be used.

The peripheries of the wafer 4 and diaphragm's opening 8 is shown as having the substantially mating conical surfaces, in this instance the conical angle being 45° in both instances.

With the spokes having their upstanding inner tips connecting with the wafer's bottom only adjacent to the wafer's periphery, this bottom is otherwise free from obstructions in radial and downward directions. There is practically nothing to prevent the entirely free flow of a viscous product downwardly from the valve's wafer. There is no projection extending upwardly from the base to this wafer on which viscous material can collect and retard free flow downwardly from the wafer's periphery.

The flange 9 extends upwardly from the rim 3 to a height above the level of the wafer's top and the diaphragm has the relatively shallow conical shape previously indicated, the diaphragm extending integrally from the top of the flange downwardly to the wafer. The conical angularity of this diaphragm can vary from 3° to 15° with respect to the flat top of the wafer 4, the angularity being 7° in the case of this illustrative example. Being conical, the diaphragm structurally tends to resist bending when a viscous product applies pressure to its inside or bottom, displacement of the diaphragm required for valve opening being obtained largely if not entirely via the top or upper portion of the flange, indicated at *9a*, which is entirely free from restraint to radial elastic flexure. In addition to this hinging action, upward displacement of the diaphragm by pressure from below has a tendency to force the bottom portion of the flange 9 radially inwardly to force the interlock between the cap and the base into tighter engagement. As shown, the base has an annular groove *3a* below its rim 3 while the cap's flange 9 has an annular inwardly extending rib *9b*, the parts *3a* and *9b* snapping together when the cap is pushed onto the base during assembly of the valve. As just explained, this interlock is enhanced by what is, in effect, a rocking action of the flange 9 when its upper portion or top portion *9a* is flexed outwardly due to upward motion of the diaphragm 7.

At this point it is best to explain that in the foregoing and hereafter, reference is made to tops, bottoms, etc., as the valve is illustrated by the drawings. Actually, when in use, a squeeze bottle is normally inverted so the positions of the parts are reversed, but this fact does not interfere with the present description of the drawings as they show the valve.

Without placing some limit on the inward motion of the diaphragm 7, it might be possible for a user by hard finger pressure to force the diaphragm completely down below the wafer 4 so as to render the valve inoperative. Therefore, although it would otherwise be desirable to have the periphery of the wafer free from all downward obstructions, the spokes 5 which extend from the bottom of the rim 3 diagonally upwardly to the wafer 4, are at a level slightly below the bottom of the wafer, extended radially outwardly to form shelves 10 with which the inner periphery of the diaphragm 7 normally does not contact but which do serve to stop downward motion of the diaphragm when it is forced downwardly by outer pressure. This keeps the valve operative under all conditions of normally expected use.

In this illustrative example, both the diaphragm and wafer are designed with a wall thickness of 0.015. This illustrates the extreme thinness of the wafer 4 and the fact that these two major valve components require very little plastic, the major amount of plastic required being for the base 1 which must have, in any event, the rigidity required for fastening to the bottle mouth, and the two interlocking portions required for easy valve assembly, keeping in mind that the upper diaphragm flange portion 9*a* should be kept with a thin wall thickness to promote the previously described hinging action. In this connection, this upper portion 9*a* is made to taper upwardly from the top of the rim 3 to the integral junction between the diaphragm 7 and the top of this portion 9*a*.

The diameter of the wafer's bottom should preferably be not more than one-third the diameter of the bottom of the diaphragm. In this illustrative example, the diameter of the wafer's bottom is 0.20" and the inside diameter of the diaphragm is 0.90". When in use on a squeeze bottle and the bottle is squeezed, the diaphragm has about the maximum imaginable piston area presented to the pressurized viscous product, this pressure being applied also to the inner surfaces of the flange tops 9*a* to promote the hinging action. Finger pressure on the normal squeeze bottle need not be very great to operate this valve.

In this inventor's prior patent, previously referred to, it is explained that a pressure relief valve or check valve is necessary in a valve of the kind here involved, and the use of the so-called duck bill type of valve was proposed. In this instance the duck bill is shown at 11 as extending transversely through the base 1 via the lower part of its rim 3 and with the duck bill's characteristic flat shape oriented vertically so as not to interfere to any substantial extent with the product flow through the valve's base 1.

FIG. 1 shows how this transversely vertically oriented duck bill extends inwardly from the base's rim 3 with the duck bill's mouth 11*a* terminating at a position outwardly offset from the wafer's periphery so as to leave the latter downwardly free from the duck bill. This, together with the duck bill's transverse vertical position, avoids entrapment of the dispensed product after the valve closes. The duck bill has a vent 11*b* extending transversely through and to the outside of the rim 3. This vent is formed by a radial slot 1*b* in the rim's top, the cap's flange 9 closing the outer end of the duck bill excepting for this slot located beneath the flange's bottom edge. The slot is of small dimensions so that the vent is of such small diameter as compared to the duck bill's diameter as to make the vent opening inconspicuous from the valve's outside.

What is claimed is:

1. A dispensing valve having a base comprising a circular rim, means for connecting said rim to a squeeze bottle's mouth, a circular wafer, and spokes connecting with and radiating from the wafer's bottom and extending radially to the rim in a plane below said bottom and positioning the wafer on and normal to the rim's axis, said wafer being thin as compared to its diameter and having a small diameter as compared to the rim's diameter and forming an annular space between the wafer and rim; and a cap comprising an elastically flexible annular diaphragm positioned above said plane and having a central opening with a periphery normally resting on the periphery of said wafer, and a depending flange connected to said rim, said peripheries having substantially mating conical surfaces, wherein substantially the entire conical surfaces contact each other, said wafer having a flat top and bottom, said spokes having inner tips which connect with said bottom only and said bottom being otherwise free from obstructions in a downward direction.

2. The valve of claim 1 in which said flange of the diaphragm extends upwardly from said rim to a height above the level of said top of the wafer and said diaphragm has a conical shape and extends integrally from the top of said flange downwardly to said wafer, the top portion of said flange being free from restraint to radial elastic flexure and made of elastically flexible material.

3. The valve of claim 1 in which said wafer and diaphragm have substantially the same thickness.

4. The valve of claim 2 in which said spokes adjacent to the periphery of said wafer and slightly therebelow form stops preventing excessive downward movement of said diaphragm.

5. The valve of claim 2 in which said diaphragm has a downward conical angularity of from 3° to 15° with respect to the flat top of said wafer.

6. The valve of claim 2 in which the diameter of the wafer's said bottom is not more than one-third the diameter of the bottom of said diaphragm.

7. The valve of claim 6 in which the diaphragm's said bottom has a diameter not smaller than 0.65" and said base and cap are each integral plastic injection moldings, the thickness of the wafer and diaphragm ranging from 0.05" to 0.3", the diaphragm's said flange tapering upwardly in thickness from the base's said rim to the diaphragm's connection with said flange.

8. The valve of claim 2 in which said base has a squeeze bottle venting check valve formed by a transversely vertically oriented duck bill extending inwardly from the base's said rim with the duck bill's mouth terminating at a position outwardly offset from said wafer's periphery so as to leave the latter downwardly free therefrom, the duck bill having a vent opening extending transversely through and to the outside of said rim.

9. The valve of claim 8 in which said vent opening is of such small diameter as compared to the duck bill's diameter as to make the vent opening inconspicuous from the valve's outside.

10. The valve of claim 1 in which the thickness of said wafer and diaphragm are within the range of from 0.05" to 0.3".

* * * * *

UNITED STATES PATENT AND TRADEMARK OFFICE

Certificate

Patent No. 4,226,342 Patented October 7, 1980

Robert H. Laauwe

Application having been made by Robert H. Laauwe, the inventor named in the patent above identified, and Essex Chemical Corp., Clifton, N.J., a Corp. of N.J., the assignee, for the issuance of a certificate under the provisions of Title 35, Section 256, of the United States Code, adding the name of Stanley L. Roggenburg, Jr. as a joint inventor, and a showing and proof of facts satisfying the requirements of the said section having been submitted, it is this 19th day of April 1983, certified that the name of the said Stanley L. Roggenburg, Jr. is hereby added to the said patent as a joint inventor with the said Robert H. Laauwe.

Fred W. Sherling,
*Associate Solicitor*